US005775757A

United States Patent [19]

Tipp

[11] Patent Number: 5,775,757

[45] Date of Patent: Jul. 7, 1998

[54] FLEXIBLE BAG HANDLE HAND GRIP

[76] Inventor: Raymond P. Tipp, P.O. Box 3778, Missoula, Mont. 59806

[21] Appl. No.: 764,785

[22] Filed: Dec. 12, 1996

Related U.S. Application Data

[63] Continuation-in-part of Ser. No. 661,748, Jun. 11, 1996, abandoned.

[51] Int. Cl.[6] ..... A45F 5/10; B65D 33/06

[52] U.S. Cl. ..... 294/171; 294/137

[58] Field of Search ..... 294/137, 166, 294/170, 171; 16/114 R, 114 B; 229/117.09, 117.19; 383/6, 13, 25; D9/434

[56] References Cited

U.S. PATENT DOCUMENTS

| | | | |
|---|---|---|---|
| 2,981,990 | 5/1961 | Balderree, Jr. | 294/137 |
| 4,796,940 | 1/1989 | Rimland | 294/171 |
| 4,923,235 | 5/1990 | Stewart | 294/171 |
| 5,029,926 | 7/1991 | Dieterich, jr. | 294/171 |
| 5,257,845 | 11/1993 | McConnell | 294/171 |

FOREIGN PATENT DOCUMENTS

| | | | |
|---|---|---|---|
| 85524 | 8/1983 | European Pat. Off. | 294/171 |
| 2253995 | 9/1992 | United Kingdom | 294/171 |

*Primary Examiner*—Dean Kramer
*Attorney, Agent, or Firm*—Harry M. Cross, Jr.

[57] ABSTRACT

A hand grip for attachment to an elongated cord-like element comprises a unitary body provided with a first aperture adjacent a first end of the body, a second aperture adjacent a second end of the body, a first slit extending from the first end to the first aperture, and a second slit extending from the second end to the second aperture. The apertures and the slits are located with respect to one another that a first pair of transverse tabs are provided between the first aperture and the first end, that a second pair of transverse tabs are provided between the second aperture and the second end, and that the tabs of each pair of transverse tabs are separated by one of the slits. The hand body is formed of a material having sufficient elasticity that the body can be longitudinally bent into a longitudinally channel without exceeding the elastic limit of the material.

7 Claims, 3 Drawing Sheets

FLEXIBLE BAG HANDLE HAND GRIP

CROSS REFERENCE TO RELATED APPLICATION

This application is a continuation-in-part of application Ser. No. 08/661,748, filed Jun. 11, 1996, now abandoned.

BACKGROUND OF THE INVENTION

1. Field of the Invention

This invention relates to devices to be applied to bag handles to shield a person's hand when lifting and carrying the bag. More particularly, this invention relates to such devices adapted to be installed on plastic bag plastic film handles and on paper bag rope handles of the type found on shopping bags.

2. Brief Description of the Prior Art

Plastic and paper shopping bags are provided with carrying handles that are uncomfortable to grasp when the bags contain heavy articles. Plastic bags are fabricated from flexible plastic film and are formed so that a pair of plastic film webs are provided as bag lifting and carrying handles, one on each side of the top of a bag opening. These webs, when grasped so as to lift a bag, collapse into thin bands of a rope-like nature. Paper bags are fabricated so that a pair of thin paper ropes are secured to sides of the tops of the bag openings to provide a pair of bag-lifting/carrying handles. In the case of both plastic and paper shopping bags, these rope-like handles are uncomfortable to use when a bag contains an aggregate heavy load. For grocery shopping bags, for example, a bag containing a twelve-pack of soft drink cans, or a gallon container of milk, becomes sufficiently weighty as to cause the rope-like handles to "dig into" a person's hand when the weighted bag is lifted. The handles are flexible and tend to form an arc when the weighted bag is lifted. However, when a person grasps the handles to lift the weighted bag, the person tends to make a closed fist that results in the fingers forming an approximately straight lifting channel about the bag handles. Consequently, the flexible handles, when the weighted bag is lifted, bear disproportionately against the outer sides of the person's index and little fingers. The degree of discomfort imposed on the person lifting and carrying a weighted bag is sufficiently extreme that the bag cannot be filled to its capacity with articles that, in the aggregate, are too heavy. Clerks that fill these shopping bags know this and, therefore, often not only do not fill the bags to their capacity but, rather, significantly underfill the bags so as to avoid being criticized by shoppers.

Hand grips have been heretofore proposed for solving the problems presented by flexible, rope-like handles on plastic and paper shopping bags. However, some such hand grips are cumbersome to apply and, once applied, are cumbersome to remove. Since shopping bags are provided with two handles, one on each side of a bag opening, when the two handles are brought together and confined by a hand grip device, access to the bag's interior is substantially reduced or eliminated until the hand grip is detached from one or both bag handles. Other such hand grips will not remain attached to the bag handles when the bag is set down, resulting in misplacement of the hand grip. These types of hand grips, may fall off the bag handles entirely, or become partially dislodged, necessitating their re-attachment when the bag is to be lifted again. Furthermore, the hand grips that have been heretofore proposed are often cumbersome to store in a convenient manner nearby where they must be applied by clerks. Some such hand grips are also too expensive to use in such common environments as the checkout stands of grocery and hardware stores, and similar kinds of stores where profit margins are relatively low. Because of these enumerated deficiencies in the hand grips heretofore proposed, none of these hand grips are in wide use, and virtually none of them are in use in low profit margin retails stores, such as grocery and hardware stores.

SUMMARY OF THE INVENTION

A primary object of the hand grip of the present invention is to provide a hand grip for plastic and paper bag handles that does not suffer from the above-enumerated deficiencies. Another object is to provide such a hand grip that is fabricated from flexible plastic sheet material. A further object is to provide such a hand grip that can be easily applied to such handles, will remain attached to the handles when a bag is set down, can be easily removed from bag handles, and is reusable. Still another object is to provide such a hand grip that can be stored flat in a compact stack of hand grips nearby the point of installation by a store clerk, such as at a checkout stand. A still further object is to provide such a hand grip in a form that provides a sufficient surface area for carrying store advertising so that the hand grip can serve an advertising function as well as a customer convenience function.

These objects and advantages will become apparent from the following description of the invention.

In accordance with these objects and advantages, the invention is a hand grip for attachment to an elongated cord-like element which comprises a unitary body provided with a first aperture adjacent a first end of the body, a second aperture adjacent a second end of the body, a first slit extending from the first end to the first aperture, and a second slit extending from the second end to the second aperture. The apertures and the slits are located with respect to one another that a first pair of transverse tabs are provided between the first aperture and the first end, that a second pair of transverse tabs are provided between the second aperture and the second end, and that the tabs of each pair of transverse tabs are separated by one of the slits. The hand body is formed of a material having sufficient elasticity that the body can be longitudinally bent into a longitudinal channel without exceeding the elastic limit of the material.

The hand grip unitary body is provided with first and second enclosing means separated by side means. The first enclosing means provides the first aperture adjacent a first end of said body with a first slit extending from said first end to said first aperture and a first pair of transverse tabs between said first aperture and said first end with said first slit extending between the tabs of said first pair. The second enclosing means provides a second aperture adjacent a second end of said body with a second slit extending from said second end to said second aperture and a second pair of transverse tabs between said second aperture and said second end with said second slit extending between the tabs of said second pair. The first and second apertures have a size sufficient to loosely contain portions of the cord-like element so that the hand grip may easily slide along the cord-like element after being applied thereto. The body is so formed as to provide a central portion extending between the apertures and the side means to provide a pair of side portions extending on either side of the central portion from one end of said body to the other end of said body with the body being bendable so as to form a longitudinal channel with the side portions of said side means extending upward from said central portion so that the hand grip may be cupped in a user's hand.

DESCRIPTION OF THE PREFERRED EMBODIMENTS

Figure 1:
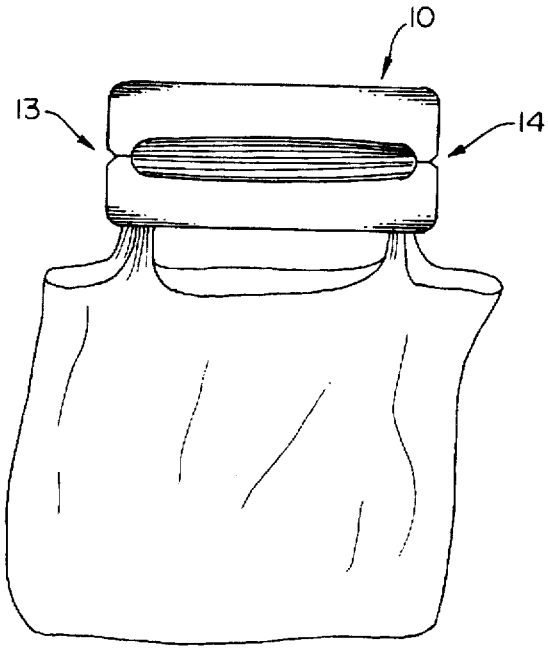
FIG. 1 is a perspective view of the hand grip of this invention applied to the plastic web handles of a plastic shopping bag, the hand grip being shown as it would appear either just after its installation, or after the bag has been set down.

The embodiment of the bag handle hand grip of this invention illustrated in FIGS. 4–8 comprises a one-piece body 10 in the form of a thin flexible rectangular sheet. The body is formed of a plastics material that is sufficiently elastic that the body 10 can be bent into a generally U-shape along its longitudinal axis without exceeding its elastic limit. Each end 11, 12 of the body is slit, as at 13, 14, from the outer edge into a circular aperture, 15, 16. When the body is bent along its longitudinal axis, a longitudinal channel configuration is provided that extends from the inner edge of one aperture 15 to the inner edge of the other aperture 16. Body side portions 10*a*, 10*b* are defined by the body ends 11, 12, the body sides edges 25, 26, and a central longitudinal portion 10*c* that extends between the apertures 15, 16. The longitudinal channel formed when the body is bent along its longitudinal axis is formed by the body side portions 10*a*, 10*b* and the body central longitudinal portion 10*c*, the central portion 10*c* constituting the base of the channel. As a result of being bent along its longitudinal axis, and the formation of a channel configuration, the edges of each slit, 13*a*, 13*b* and 14*a*, 14*b*, are pulled apart so as to provide a longitudinal gap leading into each aperture 15, 16.

Figure 4:
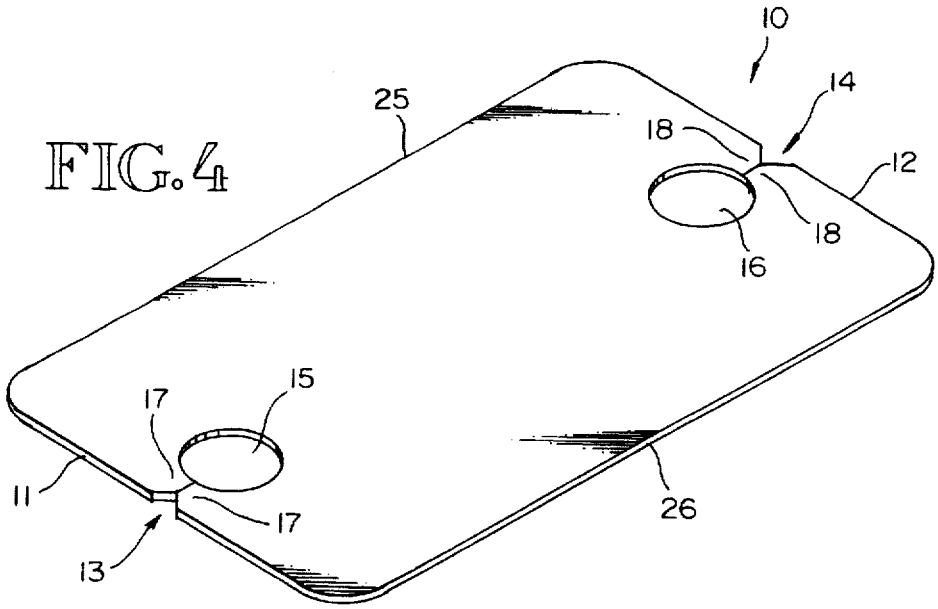
FIG. 4 is a perspective view of a first embodiment of the hand grip of this invention.
Figure 5:
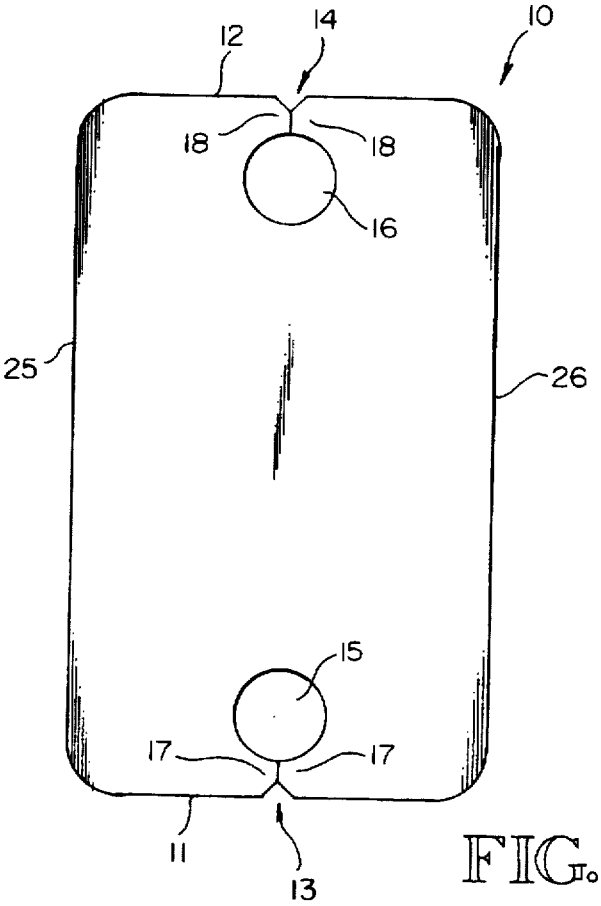
FIG. 5 is a top plan view of the FIG. 4 hand grip.
Figure 6:
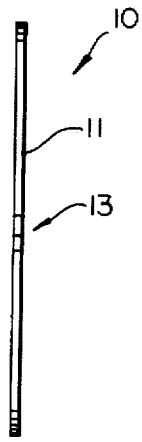
FIG. 6 is an end view of the FIG. 4 hand grip.
Figure 7:
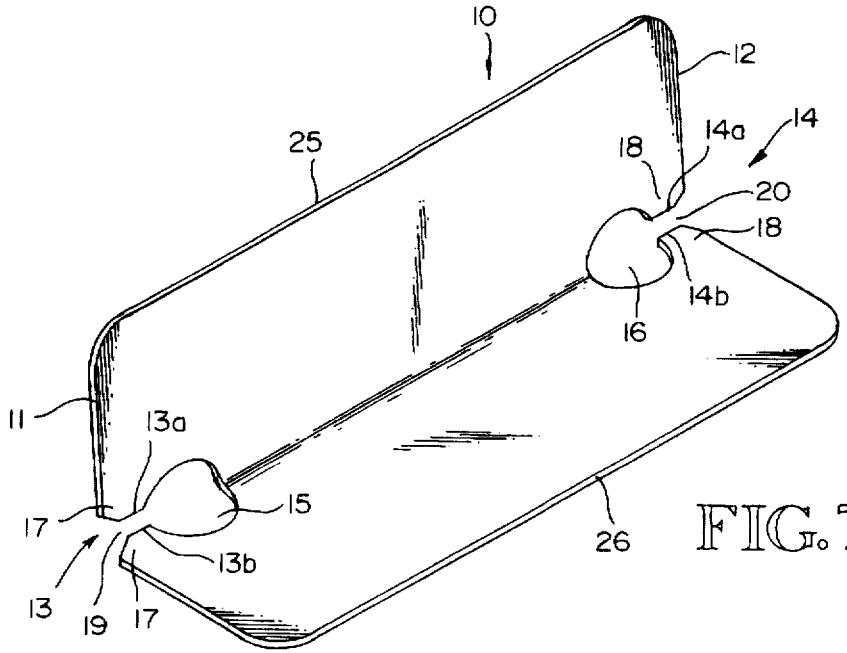
FIG. 7 is a perspective view of the FIG. 4 hand grip bent along its longitudinal axis to the point where the included angle of the longitudinal channel so-formed is about 45°.

The physical arrangement of the apertures 15, 16 with respect to their adjacent body ends, 11, 12, results in a pair of transversely oriented tabs 17, 18 wherein the tabs of each pair 17, 18 project toward one another. When the body 10 is flat and unbent, the tabs of each pair 17, 18 abut one another at the respective slits 13, 14 as seen in FIG. 4. When the body 10 is bent along its longitudinal axis, so as to provide a longitudinal channel, the tabs of each pair 17, 18 separate so as to provide longitudinal gaps 19, 20 as seen in FIG. 7. These longitudinal gaps 19, 20 extend from the body ends 11, 12 into the respective apertures 15, 16, thereby providing a passage space for ingress to and egress from the apertures 15, 16.

The body ends 11, 12 may be notched at the outer ends of the slits 13, 14 as shown so as to provide indexing and centering guides leading into the slits 13, 14. The apertures 15, 16 are spaced apart a sufficient distance that a person may cradle the body 10 in his or her hand with the outer sides of his or her index and little fingers extending across the apertures 15, 16, as seen in dashed lines 21 in FIG. 8, the dashed line representing the outline of a person's hand underlaying the grip body 10. The apertures 15, 16 are preferably circular to eliminate the presence of inside corners that might provide structural weakness.

Figure 8:
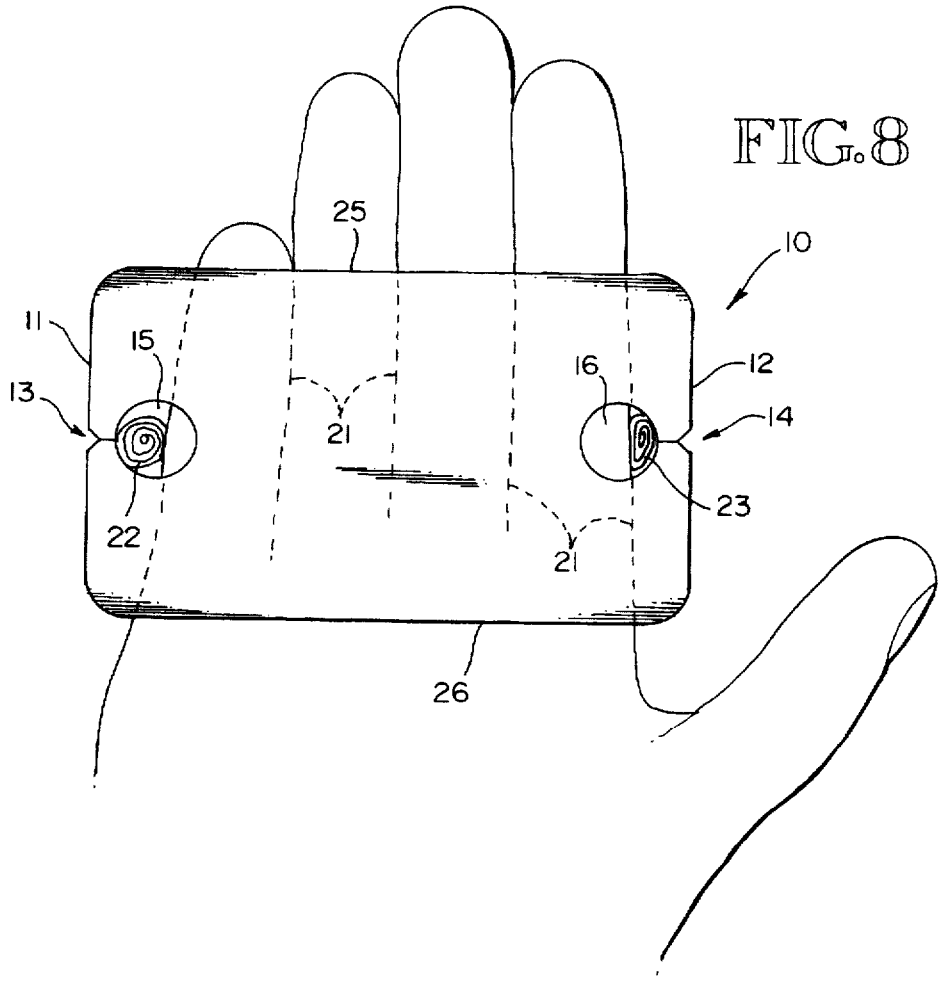
FIG. 8 is a plan view of the FIG. 4 hand grip overlaying a person's open hand.

If it is not desired to provide the hand grip in a form that is, or may not be, reusable, the apertures 15, 16 could be separated far enough apart that a person's index and little fingers would be completely covered by the body material between the apertures. The longitudinal length of the body 10 must be sufficient that all four fingers of a person's hand may be overlaid transversely across the body as seen in FIG. 8, so that at least an outer portion of each aperture 15, 16 is exposed for receipt of the bag handle. The hand grip of this invention would be extremely awkward to use if the distance between the apertures were so small that only three fingers could be accommodated; lifting and carrying a weighted bag while dangling one's little finger is not only uncomfortable but the comfortable lifting and carrying capacity of one's hand is reduced.

When the grip body 10 is to be applied to a bag handle, the body may be placed in a person's hand so as to assume the position shown in FIG. 8. The person than closes his or her hand, thereby folding, or bending, the body 10 into a channel configuration, such as in the configuration shown in FIG. 7. Then the bent body 10 may be applied to a bag handle by inserting one side of the handle through the passage 19 into the adjacent aperture 15, and by inserting the other side of the handle through the passage 20 into the adjacent aperture 16. As thus applied to a bag handle, the body 10 would appear as shown in FIG. 1, if the person's hand were removed and the body was allowed to relax to its original flat condition. As seen in FIG. 1, the ends of two bag handles are positioned in the apertures 15, 16. When the body 10 is allowed to relax to its original flat condition, the body tabs 17, 18 close off the passages 19, 20 thereby locking the bag handles into the apertures 15, 16. In order to remove the grip from the bag handles, the body 10 may be bent so as to form the longitudinal channel and so as to cause the body tabs 17, 18 to separate thereby creating the passages 19, 20 as seen in FIG. 7. The bag handles may then be easily withdrawn from the apertures 15, 16. If desired, one of the pair of bag handles may be removed, of course, leaving the grip body 10 locked onto the other bag handle.

In actual practice, a person may simply "palm" the body 10 in its flat condition with one body side edge 25 positioned adjacent the person's fingers and the other body side edge 26 positioned against the person's palm as seen in FIG. 8. The person could then place the grip body 10 beneath the bag handles, and then lift the body 10 upward so that the bag handles first contact the body ends 11, 12 and then are forced through the slits 13, 14 into the apertures 15, 16. Consequently, the notches provided at the outer ends of the slits 13, 14 will serve to self-center the body 10 against the bag handles as the body 10 is lifted upward against the bag handles. Because the tabs 17, 18 are located between the apertures 15, 16 and the adjacent respective body ends 11, 12, the tabs 17, 18 will flex, or bend, out of the way of the bag handles as the body 10 is lifted upward during the bag handle-applying process described above and then will relax to their original condition as dictated by the configuration of the body 10. In "palming" the body 10, a person may slightly bend the body along its longitudinally axis by cupping his or her fingers so that the body 10 would tend to nest into the concave configuration of the person's fingers and palm so as to stabilize the hand grip against slipping as it is applied to the bag handles.

Figure 2:
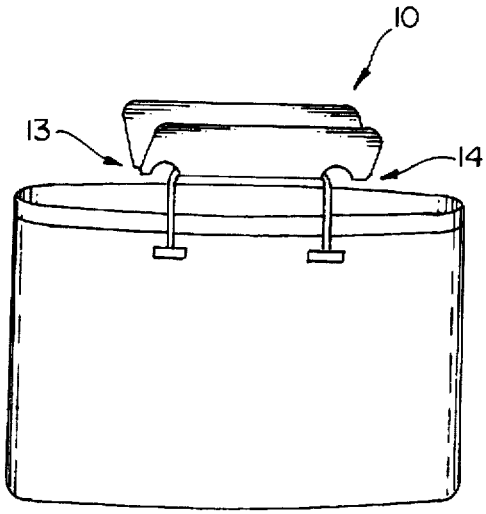
FIG. 2 is a perspective view of the hand grip of this invention applied to the paper rope handles of a paper shopping bag, the bag handles and the hand grip being shown as they would appear when the weighted bag is lifted.
Figure 3:
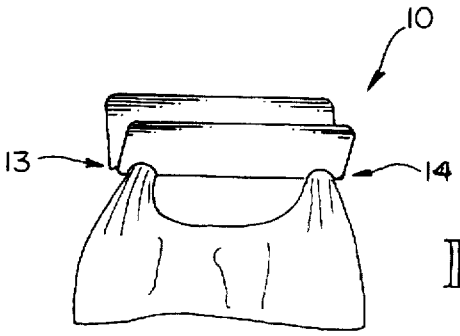
FIG. 3 is a perspective view of the top of a plastic bag with the hand grip of this invention applied to the plastic web handles, the bag handles and the hand grip being shown as they would appear when the weighted bag is lifted.

When a weighted bag is lifted, the body 10 will assume the position shown in FIGS. 2 and 3 with respect to the bag handles. Because of the channel configuration of the body 10, the body become stiff in its longitudinal direction so that the bag handles will traverse the bottom of the longitudinal channel in a generally straight-line fashion, and then turn perpendicularly downward across the inner edge of each aperture 15, 16 and extend downward through the apertures 15, 16. When the length of the body 10, from end 11 to end 12, and the location of the apertures 15, 16 is appropriately selected, the downward-projecting portions of the bag handles will extend across the outer sides of a person's index and little fingers as seen in FIG. 8. In FIG. 8, the bag handle portions are indicated at 22, 23. This configuration of the body 10 and its apertures 15, 16 will protect the body material at the inner edges of the apertures 15, 16 from being bent or cut by the handle portions 22, 23. Because the bent body 10, and its resulting longitudinal channel, are relatively stiff in the longitudinal direction, the bag handle portion that extends along the longitudinal channel will remain in a substantially straight-line condition. Consequently, the weight of the bag and its contents will be relatively evenly distributed across the person's fingers. There will be a slight tendency for the downwardly-projecting bag handle portions 22, 23 to press inward against the sides of the person's index and little fingers, but the sideways force exerted by the handle portions 22, 23 will be slight and will not cause any discomfort to a person lifting and carrying a weighted bag by the grip of this invention.

The body side portions 10*a*, 10*b* serve to shield the user's hand from the bag handles or other cord-like element while still provide a comfortable grip. It is preferable that the outer corners of the side portions 10*a*, 10*b* be shaped to eliminate sharp edges, such as by rounding as in FIGS. 4–5 or beveled.

A preferred configuration for the hand grip of this invention would be a body 4.25 inches long by 2 inches wide by 0.016–0.025 inches thick. Most preferably, the body thickness would be between 0.020 and 0.025 inches, with 0.023 inches being most preferred. The body thickness must be matched to the properties of the material from which is it made so that the body 10 may be easily flexed into a longitudinally-concave configuration by a user placing the body in his or her hand, as seen in FIG. 8 and simply folding or cupping his or her fingers around the body. For a body made from a plastics material such as high density polyethylene, a thickness not exceeding 0.023 inches is preferred.

The apertures 15, 16 are provided in a diameter of about be 0.5 inches. They could be larger but not much smaller. The key to the preferred and useful size of the apertures is that they must be sufficiently large that they will completely contain a bag handle material. When the body 10 is attached to a plastic bag handle, as seen in FIG. 1, it will often be the case that the body should be shifted along the handle to achieve a balanced lifting position. In the case of plastic bags of the type used to contain groceries and the like, when such bag handles are gripped and the bags lifted, the handle portions typically occupy, in cross-section, a diameter of about ⅜ inch. For such uses, the apertures should be about 0.5 inches in diameter so that the body will slide easily along the bag handle. When the body is thus loosely attached to a plastic bag handle portion, the body 10 may be slid along the extent of the handle portion so as to position the body along the handle portion to suit the user.

The apertures 15, 16 are preferably set into the body about ¼ inch from the body ends. The body ends are preferably notched with a 90° notch with each notch apex being located ⅛ inch inward from the adjacent body end, and the respective slits from the notch apexes to the apertures would be ⅛ inch long. The slits leading into the apertures serve only to provide a passageway for the bag handles into the apertures. The slits need only be long enough to provide sufficient material in the form of the tabs 17, 17 and 18, 18 to maintain the physical integrity of the apertures so that the bag handles, once inserted into the apertures, cannot be accidentally dislodged out between the tabs. The tabs, per se, are not intended to grip the material of the bag handles because the apertures 15, 16 are sufficiently large to completely hold the bag handle material.

The body 10 could be die cut from a sheet of such plastics material, with the apertures, slits and notches being formed in one operation, simultaneously with the body being cut or stamped from the sheet. Alternately, the body could be injection or blow molded or otherwise thermo-formed.

The body 10 could be formed of any suitably flexible thermosetting plastics material, high density polyethylene being preferred because of its combination of toughness and elasticity. High density polyethylene is highly elastic and the body 10, when made of that material, will quickly return to a flat condition after having been bent into a channel configuration, unless it is forcibly creased along its longitudinal axis. Under normal conditions, the body 10 would not be bent beyond the channel sides becoming parallel to one another, with the bottom of the channel assuming a semi-cylindrical configuration. With an appropriate choice of plastics material, such as high density polyethylene, when the body 10 is released after being bent into a channel configuration, the body will flatten out almost instantaneously to a sufficient degree that the tabs of each tab paid 17, 18 will close toward one another rapidly enough to prevent a bag handle from inadvertently falling out of either one of the apertures 15, 16.

Hand grips fabricated in accordance with this invention may be packed in storage boxes wherein many could be stored in a very compact space. Therefore, a box of these hand grips could be very conveniently stored in a drawer or under a counter adjacent to a checkout stand in a retail store operation. Consequently, it would be convenient for a checkout clerk to apply a hand grip to either a plastic or paper bag promptly after filling the bag as the last step in a checkout process.

The two faces of the body 10 provide sufficient space for the imprinting of advertising messages, coupons, and slogans, such as is illustrated in FIG. 1. Consequently, the hand grip can serve as an advertising medium in addition to serving as a customer convenience aid.

Furthermore, in addition to being fabricated from plastics material, it is possible to fabricate the body 10 from other kinds of materials that can be elastically bent into a channel configuration. Such other kinds of material may include plasticized paper or card stock. Such other material must be sufficiently elastic that the body 10 will tend to flatten out, as hereinabove described, so as to keep the bag handles confined in the apertures when the bag is set down and the hand grip is released.

While the preferred embodiments of the invention has been described herein, variations in the design may be made. For example, the body 10 and its associated structure could be employed as a hand grip for lifting and carrying any cord-like, or rope-like, element that bears a weight; such as, for example, a cord-wrapped package, the cord then serving as a "handle" in the sense that the package would be lifted by the cord segment around which the hand grip of this invention is applied in the same fashion as with a bag handle. The scope of the invention, therefore, is only to be limited by the claims appended hereto.

The embodiments of the invention in which an exclusive property is claimed are defined as follows:

1. A hand grip for attachment to an elongated cord-like element which comprises a unitary flat body having a thickness of at least 0.016 inches but not exceeding 0.025 inches, said body being provided with first enclosing means providing a first aperture adjacent a first end of said body with a first slit extending from said first end to said first aperture and a first pair of transverse tabs between said first aperture and said first end with said first slit extending between the tabs of said first pair; second enclosing means providing a second aperture adjacent a second end of said body with a second slit extending from said second end to said second aperture and a second pair of transverse tabs between said second aperture and said second end with said second slit extending between the tabs of said second pair; the tabs being unsegmented and integral with said body; the first and second apertures being circular and having a size of at least about 0.5 inches in diameter sufficient to loosely contain portions of said cord-like element so that said hand grip may easily slide along said cord- like element after being applied thereto; the first and second apertures being located close enough to their respective first and second body ends that their adjacent first and second slits each have a length less than the diameter of the adjacent aperture, and that their adjacent tabs each have a width less than the diameter of the aperture; and said body being so formed as to provide a central portion extending between said apertures and side means providing a pair of side portions extending on either side of said central portion from one end of said body to the other end of said body, said body being formed of a material having sufficient elasticity that said side portions of said body can be longitudinally bent so as to form a longitudinal channel with the side portions of said side means extending upward from said central portion so that said hand grip may be cupped in a user's hand without exceeding the elastic limit of said material.

2. The hand grip of claim 1 wherein said first and second pairs of transverse tabs are shaped so that the tabs of each pair separate when said body is bent into a longitudinal channel to transform said first and second slits into longitudinal passages leading from said first and second ends into said first and second apertures.

3. The hand grip of claim 2 wherein said first and second apertures are spaced apart from one another a distance slightly less than a person's hand.

4. The hand grip of claim 1 wherein said body is formed from a thin sheet of plastics material.

5. The hand grip of claim 4 wherein said first and second pairs of transverse tabs are shaped so that the tabs of each pair separate when said body is bent into a longitudinal channel to transform said first and second slits into longitudinal passages leading from said first and second ends into said first and second apertures.

6. The hand grip of claim 5 wherein said first and second apertures are spaced apart from one another a distance slightly less than a person's hand.

7. The hand grip of claim 1 wherein the first and second body ends are each notched inward about ⅛ inch from their respective body ends and wherein said first and second slits are each about ⅛ inches long, with said first and second tabs being about ¼ inches wide.

* * * * *